United States Patent [19]

Setterberg, Jr. et al.

[11] 4,441,553

[45] Apr. 10, 1984

[54] ANCHOR FOR USE IN A WELL

[75] Inventors: John R. Setterberg, Jr., Richardson; Dhirajlal C. Patel, Carrollton, both of Tex.

[73] Assignee: Otis Engineering Corporation, Dallas, Tex.

[21] Appl. No.: 408,454

[22] Filed: Aug. 16, 1982

[51] Int. Cl.[3] ..... E21B 33/129; E21B 33/12; E21B 23/00; E21B 33/128

[52] U.S. Cl. ..... 166/138; 166/140; 166/216; 166/217; 166/206

[58] Field of Search ..... 166/138, 139, 140, 214, 166/215, 216, 217, 206, 207, 209; 24/263 DC, 263 D

[56] References Cited

U.S. PATENT DOCUMENTS

| | | | |
|---|---|---|---|
| 2,261,564 | 11/1941 | Robichaux | 166/301 |
| 2,373,880 | 4/1945 | Driscoll | 166/208 |
| 3,279,542 | 10/1966 | Brown | 166/139 |
| 4,176,715 | 12/1979 | Bigelow | 166/138 |

*Primary Examiner*—Ernest R. Purser
*Assistant Examiner*—Timothy David Hovis
*Attorney, Agent, or Firm*—Vinson & Elkins

[57] ABSTRACT

A packer utilizing a C-slip in which, during release of the packer, the upper expander pulls the C-slip off of the lower expander. If a packer is stuck in the well, the upper expander is keyed to the slip to prevent rotation of the upper expander during milling.

6 Claims, 8 Drawing Figures

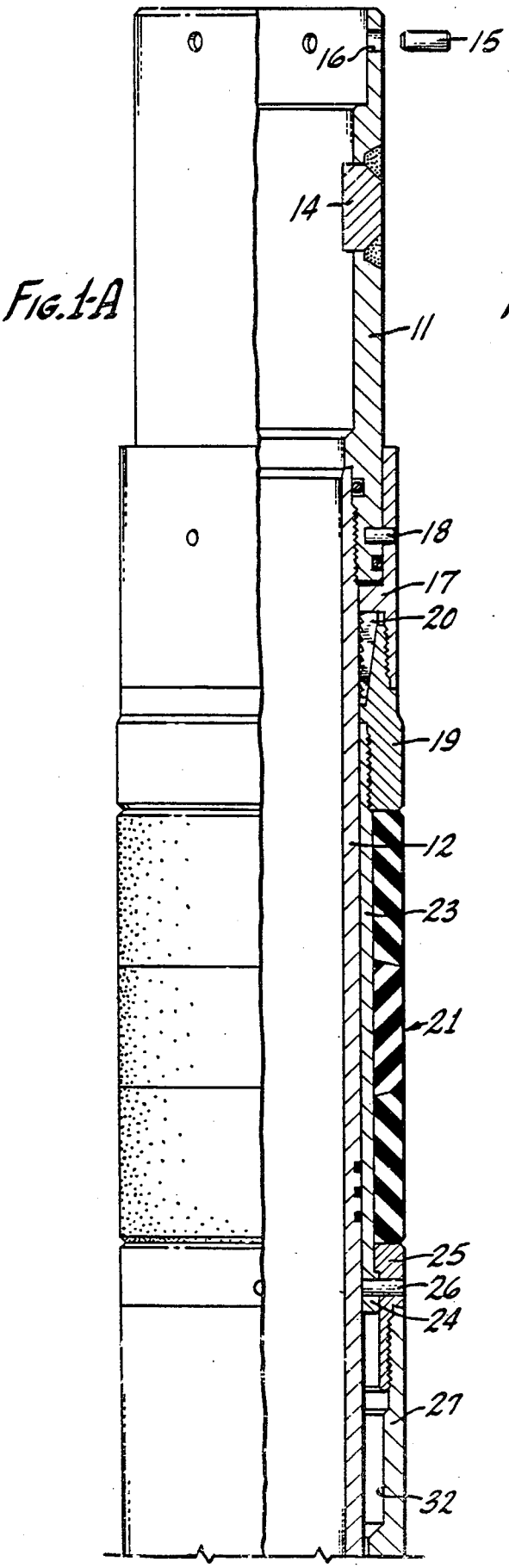
FIG. 1-A
15
16
14
11
18
17
20
19
12
23
21
25
26
24
27
32
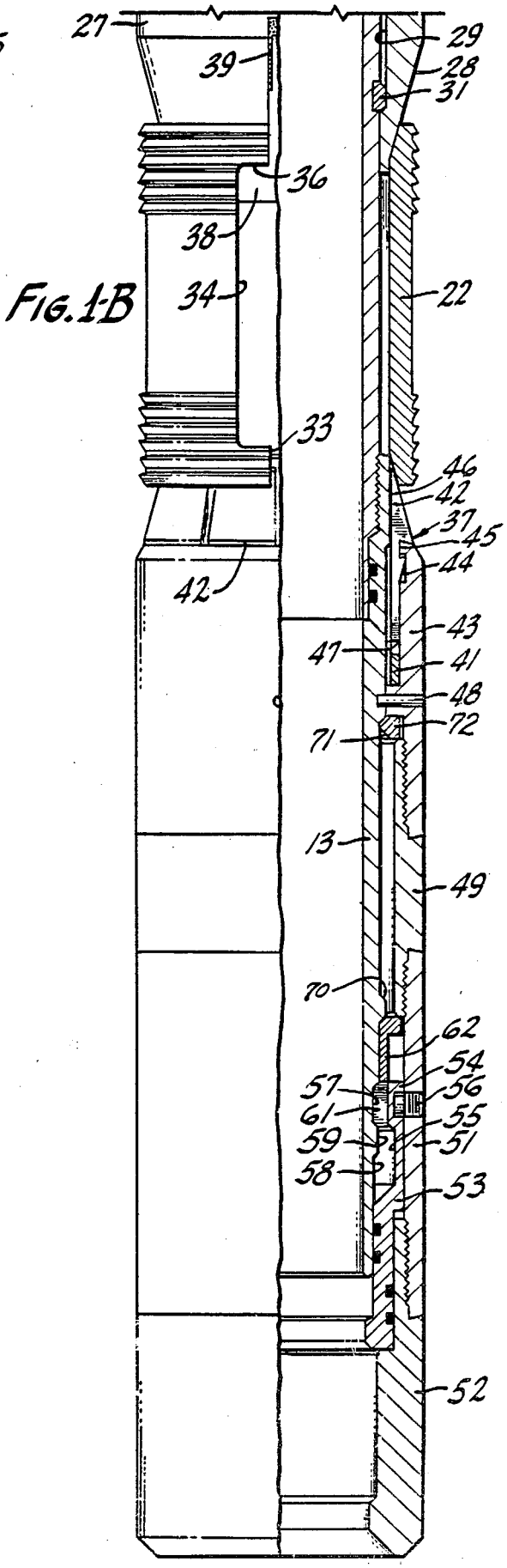
FIG. 1-B
27
39
29
28
31
36
38
34
22
33
46
42
37
45
44
42
43
47
41
48
72
71
13
49
70
62
54
57
56
61
55
59
51
58
53
52

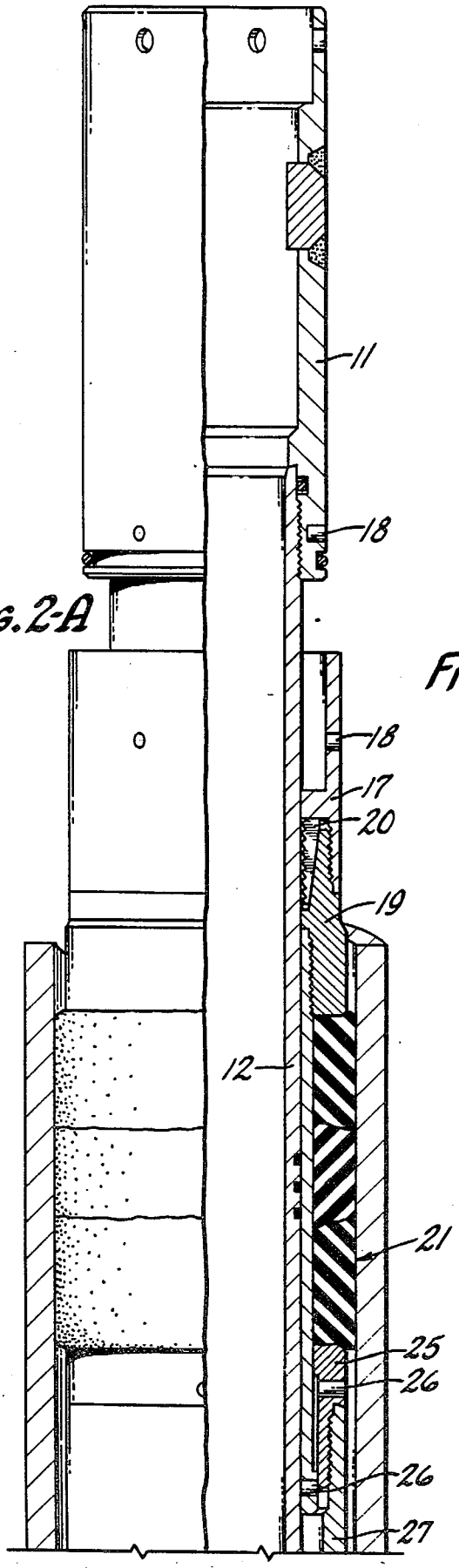
FIG. 2-A
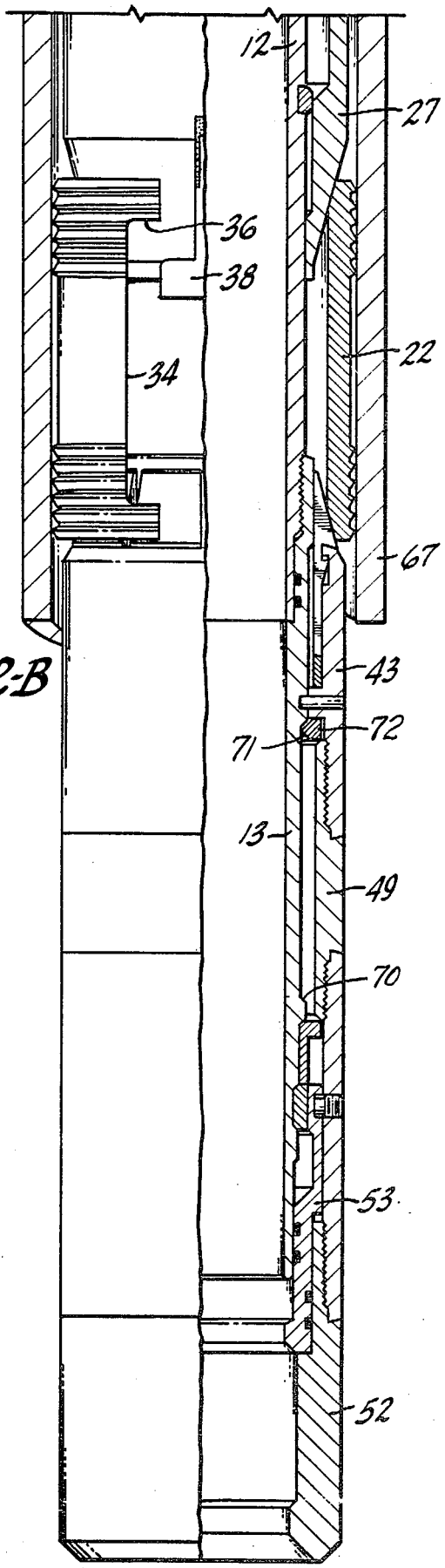
FIG. 2-B

ANCHOR FOR USE IN A WELL

This invention relates to anchors for use in a well. In one form, the anchor provides a part of a well packer.

Well packers conventionally use segmented slips. C-slips have been used with a downwardly facing cone. See U.S. Pat. No. 2,999,544. So far as is known, commercial structures have not been available using a C-slip with an upwardly facing cone.

An object of this invention is to provide a practical anchor or packer which employs a C-slip for anchoring against movement in both directions.

Another object is to provide a practical packer held against movement in both directions in which C-slips are used to provide a thinner wall section between the exterior of the tool and the bore therethrough.

Another object is to provide an anchor or packer utilizing a C-slip in which an upper and lower expander are utilized and the upper expander is keyed to the C-slip to prevent rotation of the upper expander during milling operation.

Another object is to provide an anchor or packer as in the preceding object in which the structure keying the C-slip to the upper expander provides the means for pulling the C-slip off of the lower expander.

Other objects, features and advantages of the invention will be apparent from the drawings, the specification and the claims.

In the drawings, wherein like reference numerals indicate like parts, and wherein an illustrative embodiment of this invention is shown:

FIGS. 1A and 1B are continuation views partly in elevation and partly in section of a packer constructed in accordance with this invention and shown with the parts positioned for running the packer into the hole;

FIGS. 2A and 2B are views similar to FIGS. 1A and 1B showing the packer set in the hole;

Figure 5:
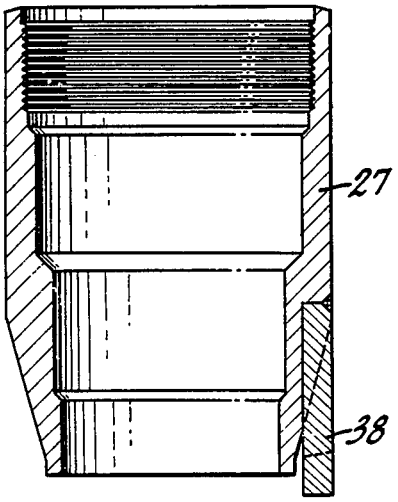
FIG. 5 is a view along the lines 5—5 of FIG. 4.
Figure 4:
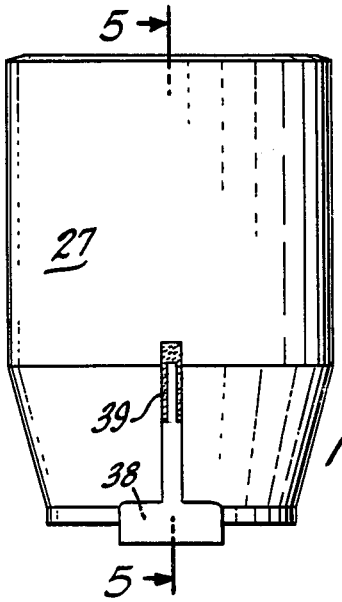
FIG. 4 is an elevational view of the upper expander and lug.
Figure 3:
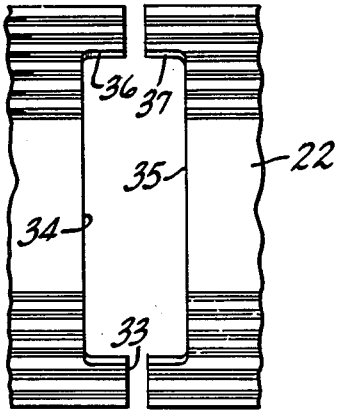
FIG. 3 is a fragmentary elevational view of the slotted portion of the C-slip.

Referring first to FIGS. 1A and 1B, the anchor is shown to be associated with packing elements so that the entire assembly is a packer but it will be understood that the anchoring system may be utilized in any instance when it is desired to anchor a member in a well.

A mandrel is provided by a top sub 11, a sleeve 12 depending from the top sub and a latch sleeve 13 secured to the lower end of sleeve 12.

The top sub 11 carries an internal lug 14 which will be utilized with a J-slot on a tubing landed in the upper end of the packer to latch a tubing to the packer, and which may be utilized with a pulling tool to pull the packer from the well.

At the upper end of the top sub 11, a shear pin 15 is shown which extends through a hole 16 and latches the packer to a running tool. After the packer has been set, the pin 15 is sheared to release the running tool from the packer.

A wireline adapter 17 is secured to the top sub 11 by shear pin 18. Secured to the lower end of the wireline adapter is the internal slip retainer 19 which carries the internal slip 20.

The setting tool utilizes a sleeve which telescopes over the top sub 11 and engages the upper end of the wireline adapter 17. When the packer is in the desired position, the setting tool is activated to drive the wireline adapter 17 downwardly to compress the packing elements indicated generally at 21 and to set the C-slip 22. As the slip retainer 19 moves downwardly, the wireline adapter 17 will carry the internal slip 20 downwardly with the slip retainer 19. In the conventional manner, the exterior surface of the internal slip 20 and the interior surface of the upper end of internal slip retainer 19 have mating frusto conical surfaces which wedge the internal slip 20 against the mandrel sleeve 12 and prevent upward movement of the internal slip retainer 19 relative to the sleeve 12 to hold the packer in set position.

Depending from the internal slip retainer 19 is a packer sleeve 23 which supports the packer elements 21 against collapse and which effects the expansion of the C-ring 22.

At its lower end, the packer sleeve 23 has an enlarged flange 24 which cooperates with an internally projecting flange on the upper end of the packer element retainer 25. As is conventional, the packer elements 21 are compressed between the internal seal retainer 19 and the packer element retainer 25 when these two parts are moved toward each other.

The packer element retainer 25 is also pinned to the packer sleeve 23 by the shear pin 26 which is sheared after the C-ring is set to permit the internal slip retainer 19 to move downwardly toward the packer element retainer 25 to expand the packing elements 21.

Depending from the packer element retainer 25 is the upper expander 27. This expander has on its lower end the frusto conical section 28 for expanding the C-ring 22.

The lower end of expander 27 has its bore 29 spaced from the mandrel sleeve 12 to provide space for the snap ring 31 on the mandrel sleeve 12 to reciprocate relative to the upper expander 27. Above the bore 29, the upper expander 27 has a still further enlarged bore 32 to provide space for the packer sleeve 23 to move downwardly relative to the upper expander 27.

The C-ring 22 is preferably fabricated with teeth facing in opposite directions to engage the wall of a casing. The C-ring 22 should be very strong and is shown in FIG. 1B in its relaxed running position. The high strength of the C-ring will prevent it from being accidentally expanded to cooperate with either the upper or lower expanders during running or pulling of the tool. This will prevent the tool from inadvertently latching when going through obstructions such as a sand bridge, tight spots in the casing or the like.

At the split 33 in the C-ring, the ring is provided with a slot. This slot is provided by cutting out a portion of the C-ring at 34 and 35 in the C-ring on opposite sides of the split 33. The slot terminates below the upper end of the C-ring to provide the shoulders 36 and 37.

Means are carried by the mandrel for cooperating with the slot and shoulders 36 and 37 to suspend the C-ring 22 and to pull the C-ring 22 off of the lower expander indicated generally at 37. In the preferred form of the tool, the means is provided by a T-shaped lug 38 which is secured to the upper expander 27 as by welding the vertical leg of the T to the upper expander as at 39. The cross of the T-shaped lug 38 reciprocates in the slot 34–35 and is engageable with the shoulders 36 and 37 in the C-ring to support the C-ring when the tool is being run as shown in FIG. 1B and to pull the C-ring off of the expander.

The lower expander may be a solid cone-shaped member such as the expander surface 28 of the upper expander 27 but it is preferred that the expander cone be collapsible at least to a limited extent, and for this purpose, the lower expander is provided by a collet 41 having collet fingers 42 with upwardly and inwardly facing frusto conical surfaces thereon to engage the mating surface in the bore through the C-ring 22 to expand the C-ring. The collet 41 is mounted in a collet carrier 43 having an internal groove 44 therein which cooperates with an external groove 45 in the outer diameter surface of the collet fingers 42 in an interlocking fashion to secure the collet fingers to the collet carrier.

The upper end of the latch sleeve 13 is enlarged at 46 to provide a collet prop-out which maintains the collet fingers 42 in their expanded position during running of the tool as shown in FIG. 1B and while set as shown in FIG. 2B. When the tool is pulled, the latch sleeve 13 moves upwardly and has a reduced diameter section 47 which moves under the expander surfaces of the collet fingers 42 to permit them to collapse against this surface to permit the C-ring 22 to contract and reduce the frictional forces between the collet fingers 42 and the C-ring.

The collet carrier 43 is pinned to the latch sleeve 13 by the shear pin 48 while the tool is being run and set.

At the bottom of the packer, means are provided for releasing the packer by releasing the mandrel from the lower expander and permitting the mandrel to move the upper expander from under the slips and to pull the slip off of the lower expander utilizing said lug and thereafter support the slip 22 on the lug 38. The collet carrier 43 has depending therefrom, a connector 49 which, in turn, is connected to a shear sleeve 51 which carries the bottom sub 52. Within the shear sleeve 51 and the bottom sleeve 52, is a snap ring retainer 53 which has an internal land portion 54 and groove 55. The snap ring 53 is secured to the shear sleeve 51 by the shear pin 56.

The latch sleeve 13 has grooves 57 and 58 spaced by land 59 on the external surface of the latch sleeve 13. With the tool in running condition, the lower expander 37 is releasably latched to the mandrel by a snap latch ring 61 which is held in groove 57 by the land portion 54 of the snap ring retainer 53. When the tool is to be unlatched, a retrieving tool is run in and engages the lower end of the snap ring retainer 53. Upward movement of the retainer 53 shears the pin 56 moving the retainer 53 up to register the groove 55 with the snap ring 61. The mandrel can then be moved upwardly relative to the lower retainer by shearing pin 48. The stop ring 62 will prevent upward movement of the snap ring 61 thus moving the latch sleeve 13 up to the point at which the snap ring 61 drops into the groove 58 permitting free upward movement of the mandrel and the latch sleeve 13 as the groove 58 is provided by a reduced diameter section extending to the bottom of the latch sleeve 13.

The shear pin 48 maintains a relationship of the lower expander 37 and shear sleeve 51 with the latch sleeve 13 while the snap ring retainer 53 is being shifted. After the ring has been shifted to release the latch sleeve 13, movement of the latch sleeve will shear the pin 48 and release it from the lower retainer.

Figure 6:
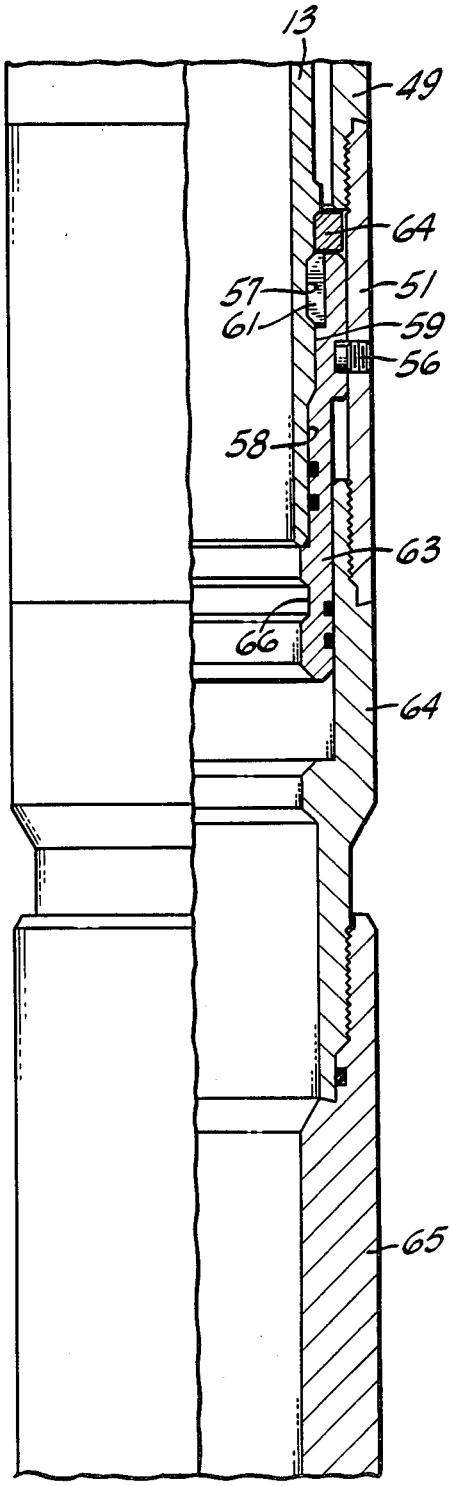
FIG. 6 is a view partly in elevation and partly in section of a modified form of latch for the packer.

In FIG. 6, a modified form of release means is shown which releases by moving a snap ring retainer 63 downwardly. Other than the design of the retainer 63, and the inclusion of a spacer ring 64, the release portion of the tool is the same as described. The bottom sub 64 is threaded at its lower end and supports a tail pipe 65 if desired.

The snap ring retainer 63 has an internal groove 66 which will be engaged by a running tool and a downward jarring of the running tool will result in shearing of pin 56 and downward movement of the snap ring retainer 63 to release snap latch ring 61. Thereafter, the latch sleeve 13 may be freely moved upwardly past the snap latch ring 61 and spacer 64 to release the tool from the well.

In operation, the tool is made up on a suitable running tool having a sleeve depending over the top sub 11 and in engagement with the wireline adapter 17. When the packer reaches the desired position in the well, the running tool is actuated. For instance, the running tool might employ a hydraulic piston, explosives or an electric motor to drive the sleeve of the running tool downwardly relative to the top sub 11 and shear pin 18 driving the wireline adapter 17 and the internal seal retainer 19 downwardly. This moves the packer sleeve 23 and the upper expander 27 downwardly. Downward movement of the upper expander 27 drives the C-ring 22 onto the cone of the lower expander 37 and the upper expander 37 will have its expander surface 28 also driven behind the C-ring 22 to firmly expand the C-ring into engagement with the casing of a well. As the C-ring is quite strong, several thousands pounds of force will be necessary to set the C-ring. After the C-ring is set and further downward movement of the upper expander 27 is arrested, the shear pin 26 between the upper expander and the packer sleeve 23 will release and continued downward movement of the internal sleeve retainer 19 will expand the packing elements 21 into engagement with the casing to seal therewith. The internal slip 20 will then cooperate with the slip retainer 19 to hold the slip retainer 19 downwardly in packer expanding position.

After the packer is set, the pins 15 in the top sub 11 are sheared and the running tool removed. Thereafter, a production tubing will be run in and a J-slot on the tubing will cooperate with lug 14 to latch the tubing to the packer.

When it is desired to remove the packer, the tubing is unlatched from latch 14 and removed. A pulling tool will then be run into the well and secured to the lug 14 by a suitable J-slot in the pulling too. The pulling tool will have at its lower end a means for engaging the bottom of the snap ring retainer 53 if an upward force to be applied to release the snap ring 61 or a means will be provided for engaging in the groove 66 of the FIG. 6 form if a downward force is to be utilized. In either event, the pulling tool is run in and engaged with the lug 14 and is activated to exert the appropriate upward or downward force on the snap ring retainer to move the snap ring retainer from behind the snap latch ring 61 to permit it to expand. Thereafter, an upward force is applied to the lug 14 and thus to the mandrel to move the mandrel upwardly relative to the remainder of the tool. The shear pin 48 which has been holding the lower retainer and mandrel in the relationship shown in FIG. 1B while the snap ring retainer is shifted, is now sheared to permit the mandrel to move upwardly.

Upward movement of the mandrel brings the upper end of the latch sleeve 13 into contact with the lower end of the upper expander 27 and pulls the upper expander from behind the C-ring 22. Prior to this time, the prop-out surface 46 moves from under the collet fingers 42, they collapse, releasing the C-ring from the casing 67 and reducing the frictional engagement between the C-ring and the collet fingers. When the prop-out moves up to the upper end of the C-ring and pulls the upper expander from behind the C-ring 22, the upper end of the C-ring is permitted to collapse and release the casing 67. At this time, the lug 38 comes into engagement with shoulders 36 and 37 and pulls the C-ring off of the lower expander 37 and supports the C-ring above the lower expander so that the C-ring may pass through obstructions in the well as it is pulled from the well without thereafter being expanded.

As the mandrel is pulled upwardly, the snap ring 31 carried on the mandrel sleeve 12 moves into abutment with the lower end of the packer sleeve 23 and moves it upwardly with the mandrel to release the packer elements 21 and permit them to return to the position shown in FIG. 1A.

Referring to FIG. 2B, it will be noted that in set position the C-ring has been expanded so that the groove 34–35 is no longer in contact with the head of the T-shaped lug 38. In retrieving the packer, the prop-out releases the lower collet permitting the lower portion of the C-ring to be free to contract. The lug moves upwardly with the upper expander 27 and thus the C-ring is released to contract prior to the lug 38 reaching the shoulders 36 and 37. If desired, the relationship of the depth of the groove and the width of the head of the lug 38 may be such that the lug will engage the shoulders 36 and 37 even with the C-ring in full expanded position. Upward movement of latch sleeve 13 shears pin 48, and the sleeve moves upward until shoulder 70 on the sleeve engages surface 71 of split ring 72 and suspends the connector 49 and structures secured thereto on the sleeve.

By providing the lug receiving slot in the C-ring at the split in the ring and utilizing the shoulders at the upper end of the slot to engage the lug to pull the C-ring off of the lower expander and support it thereabove during point of the tool, a very strong C-ring may be utilized. The ring is not weakened by providing a slot other than at the split section and there are no stress concentration points such as might be present if an internal flange were provided in the C-ring. Thus, a very strong dependable C-ring may be utilized as a slip and will have the strength necessary to hold it in collapsed unstressed condition so that the C-ring will not interfere with running or pulling the tool through their places, sand bridges or the like indication.

The foregoing disclosure and description of the invention are illustrative and explanatory thereof and various changes in the size, shape and materials, as well as in the details of the illustrated construction may be made within the scope of the appended claims without departing from the spirit of the invention.

What is claimed is:

1. An anchor comprising a mandrel, a lower slip expander on the mandrel having an upwardly facing cone, releasable latch means latching the lower expander to the mandrel, an upper slip expander on the mandrel having a downwardly facing cone, a C-ring slip positioned on the mandrel between said upper and lower expander, means movable relative to said mandrel for moving said upper expander downward for setting said slip, a slot in the C-ring slip extending to either side of the split portion of the slip with the slip providing shoulders at the upper end of the slot, a lug carried by the upper expander and reciprocal in said slot and engageable with said slip shoulders to pull the slip off of the lower expander and support said slip, and means carried by said mandrel for moving said upper expander from under said slip and pulling said slip off of said lower expander with said lug.

2. The anchor of claim 1 wherein the lower expander is a collet-type cone and the mandrel carries a prop-out positioned behind the split segments of the collet-type cone until the latch means is released and the mandrel is moved upwardly relative to the lower expander and the prop-out is moved from beneath the lower expander.

3. The anchor of claim 1 wherein the lug is engageable with the side walls of said slot upon rotation of the upper expander relative to the slip to prevent rotation of the upper expander during milling out of a stuck anchor.

4. A packer comprising a mandrel, a lower slip expander on the mandrel having an upwardly facing cone, releasable latch means latching the lower expander to the mandrel, an upper slip expander on the mandrel having a downwardly facing cone, packer means associated with the upper expander, a C-ring slip positioned on the mandrel between said upper and lower expander, means movable relative to said mandrel for moving said upper slip expander downward for setting said slip and expanding said packer means, a slot in the C-ring slip extending to either side of the split portion of the slip with the slip providing shoulders at the upper end of the slot, a lug carried by the upper expander and reciprocal in said slot and engageable with said slip shoulders to pull the slip off of the lower expander and support said slip, and means carried by said mandrel for releasing said packer and removing said upper expander from under said slip and pulling said slip off of said lower expander with said lug.

5. The packer of claim 4 wherein the lower expander is a collet-type cone and the mandrel carries a prop-out positioned behind the split segments of the collet-type cone until the latch means is released and the mandrel is moved upwardly relative to the lower expander and the prop-out is moved from beneath the lower expander.

6. The packer of claim 4 wherein the lug is engageable with the side walls of said slot upon rotation of the upper expander relative to the slip to prevent rotation of the upper expander during milling outt of a stuck packer.

* * * * *